US008073370B2

(12) United States Patent
Sano et al.

(10) Patent No.: US 8,073,370 B2
(45) Date of Patent: Dec. 6, 2011

(54) IMAGE FORMING APPARATUS HAVING A MECHANISM FOR DETECTING A MARK ON A BELT

(75) Inventors: Tetsuya Sano, Mishima (JP); Akimichi Suzuki, Yokohama (JP); Yuki Nishizawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 637 days.

(21) Appl. No.: 12/185,945

(22) Filed: Aug. 5, 2008

(65) Prior Publication Data

US 2009/0060599 A1 Mar. 5, 2009

(30) Foreign Application Priority Data

Aug. 31, 2007 (JP) ..... 2007-225366

(51) Int. Cl.
*G03G 15/01* (2006.01)
*G03G 15/00* (2006.01)

(52) U.S. Cl. ..... 399/301; 399/49

(58) Field of Classification Search ..... 399/301, 399/49

See application file for complete search history.

(56) References Cited

U.S. PATENT DOCUMENTS 5,740,492 A * 4/1998 Deki et al. ..... 399/66
6,980,749 B2 12/2005 Yoda et al.
2007/0166081 A1* 7/2007 Omata et al. ..... 399/299

FOREIGN PATENT DOCUMENTS

JP 2001-5527 A 1/2001
JP 2001-215857 A 8/2001
JP 2002-244525 A 8/2002
JP 2005-10701 A 1/2005
JP 2006-113130 A 4/2006

OTHER PUBLICATIONS

Machine translation of reference Kokubo (JP 2006-113,130, Listed in IDS) Pub date Apr. 27, 2006.*
Machine translation of reference Kurahashi (JP 2001-005,527, Listed in IDS) Pub date Jan. 12, 2001.*

* cited by examiner

*Primary Examiner* — David Gray
*Assistant Examiner* — Rodney Bonnette
(74) *Attorney, Agent, or Firm* — Fitzpatrick, Cella, Harper & Scinto

(57) ABSTRACT

A circumferential length of a belt is measured within a short period of time. A plurality of marks is provided on a belt. Distances between the marks are set to be all different from each other. The distance between the marks is set to allow the mark to be identified by measuring a period of time between the detection of one mark and that of the next mark even if the length of the belt is changed to some degree by the expansion of the belt or the like. Then, a period of time between the identified mark and the next mark is accurately measured. The total circumferential length of the belt is measured based on the results of measurement.

7 Claims, 6 Drawing Sheets

| | CALCULATION TIME FOR CIRCUMFERENTIAL LENGTH VARIATION | IMAGE DEFICIENCY |
|---|---|---|
| EMBODIMENT | SHORT | GOOD |
| COMPARISON EXAMPLE 1 | LONG | GOOD |
| COMPARISON EXAMPLE 2 | SHORT | BAD |

IMAGE FORMING APPARATUS HAVING A MECHANISM FOR DETECTING A MARK ON A BELT

BACKGROUND OF THE INVENTION

1. Field of the Invention

The present invention relates to an image forming apparatus having a mechanism for detecting a mark on a belt to prevent the misregistration of a toner image to be formed.

2. Description of the Related Art

In recent years, a tandem image forming apparatus has been proposed as a full-color image forming apparatus using an electrophotographic process. The tandem image forming apparatus includes a plurality of photosensitive drums arranged in a row, which respectively correspond to toner colors, to sequentially superimpose toner images on an image bearing belt (intermediate transfer belt), thereby obtaining a desired image.

FIG. 9 illustrates a schematic configuration of an image forming apparatus in the background art. The image forming apparatus illustrated in FIG. 9 is provided with image forming units (1Y, 1M, 1C and 1K) for yellow (Y), magenta (M), cyan (C) and black (K) toners, respectively. In the respective image forming units 1, toner images are sequentially transferred onto an intermediate transfer belt 18.

The transfer of the toner images onto the intermediate transfer belt 18 is performed in nip portions (primary transfer portions N) between photosensitive drums (2Y, 2M, 2C and 2K) respectively provided for the image forming units 1 and primary transfer rollers (5Y, 5M, 5C and 5K).

Specifically, a transfer bias is applied from a primary transfer bias supply (not illustrated) to each of the primary transfer rollers 5 to transfer the toner image from a surface of the photosensitive drum 2 onto the intermediate transfer belt 18 by an electrostatic force. The toner images on the surfaces of the photosensitive drums 2 are formed by the following process.

The surfaces of the photosensitive drums 2 are uniformly charged by charging rollers (3Y, 3M, 3C and 3K) provided in contact with the photosensitive drums 2. A modulated laser beam is emitted from each of exposure devices (7Y, 7M, 7C and 7K) based on image information to form an electrostatic latent image on the surface of each of the photosensitive drums 2.

For the electrostatic latent images respectively formed on the surfaces of the photosensitive drums 2, development units (4Y, 4M, 4C and 4K) respectively containing the yellow (Y), magenta (M), cyan (C) and black (K) toners feed the toners to visualize the electrostatic latent images as the toner images. Then, in each of the primary transfer portions N, the toner image is transferred onto the intermediate transfer belt 18. The residual toner remaining on the surfaces of the photosensitive drums 2 without being transferred to the intermediate transfer belt 18 is cleaned by each of cleaning units (6Y, 6M, 6C and 6K).

The toner image transferred onto the intermediate transfer belt 18 is conveyed to a secondary transfer portion M (nip portion between a secondary transfer opposing roller 12 and a secondary transfer roller 14) with the movement of the intermediate transfer belt 18 to be transferred onto a sheet material. The intermediate transfer belt 18 is movably looped around a driving roller 11, the secondary transfer opposing roller 12, and a tension roller 13. In other words, a driving roller 11 and a tension roller 13 are stretching members for stretching the intermediate transfer belt 18. The driving roller 11 is rotationally driven to move the intermediate transfer belt 18 in a direction indicated by an arrow of FIG. 9.

For transferring the toner image onto the sheet material in the secondary transfer portion M, the sheet materials fed one by one from a feeding portion (not illustrated) are temporarily stopped to wait between a registration roller pair 20 provided before the secondary transfer portion M.

Thereafter, the registration roller pair 20 is rotated according to arrival timing of the toner image at the secondary transfer portion M to feed the sheet material to the secondary transfer portion M, thereby transferring the toner image to a desired position of the sheet material.

If a deviation occurs between the timing for feeding the sheet material to the secondary transfer portion M and the timing for conveying the toner image on the intermediate transfer belt 18 to the secondary transfer portion M, it becomes difficult to transfer the toner image to a desired position of the sheet material. As a result, defect such as image quality degradation occurs.

In the image forming apparatus in this background art, on the assumption that a circumferential length of the intermediate transfer belt and a conveying speed of the toner image remain constant, a time length required for the toner image to reach the secondary transfer portion M is calculated based on writing start timing of the electrostatic latent image onto the photosensitive drum.

Specifically, a period of time required for the toner image to reach the secondary transfer portion M is pre-calculated. The registration roller pair feeds the sheet material to the secondary transfer portion M based on the calculated time to synchronize the arrival timing of the toner image with the conveying timing of the sheet material.

In this case, on the assumption that the circumferential length of the intermediate transfer belt remains constant, the time required for the toner image to reach the secondary transfer portion M is calculated. Therefore, it is difficult to cope with the occurrence of expansion and contraction of the intermediate transfer belt due to an environmental change such as a change in temperature or humidity or a change with time.

Specifically, when the circumferential length of the intermediate transfer belt changes, the time required for the toner image on the intermediate transfer belt to reach the secondary transfer portion also changes. Therefore, the deviation between the arrival timing of the toner image and the conveying timing of the sheet material is occurred, and the image quality degrades.

Therefore, as described in Japanese Patent Application Laid-Open No. 2001-215857, the invention relating to an image forming apparatus for correcting a deviation between the arrival timing of the toner image and the conveying timing of the sheet material to cope with a variation in circumferential length of the intermediate transfer belt is presented.

Japanese Patent Application Laid-Open No. 2001-215857 discloses a constitution including a mark provided at one position on the intermediate transfer belt and a sensor for detecting the passage of the mark. The passage of the mark is detected with the sensor to calculate a circumferential length variation of the intermediate transfer belt.

However, the following problem arises in the image forming apparatus described in Japanese Patent Application Laid-Open No. 2001-215857.

When the passage of the mark provided at one position on the intermediate transfer belt is detected to calculate the circumferential length variation of the intermediate transfer belt, the intermediate transfer belt moves approximately two circumferential lengths to measure the circumferential length of the intermediate transfer belt at some detection start timing.

SUMMARY OF THE INVENTION

The present invention has an object of providing a plurality of marks on a belt to efficiently prevent a color drift. The present invention has another object of recognizing which of the plurality of marks on the belt has opposed a sensor within a short period of time.

A further another object of the present invention is to provide an image forming apparatus including: a moving endless belt; a first mark arranged on the belt; a second mark arranged on the belt at a distance shorter than a half of a circumferential length of the belt from the first mark in a moving direction of the belt; a sensor provided at an opposing position to recognize that the first mark and the second mark oppose the opposing position; and a detecting portion detecting which of the first mark and the second mark passes based on a time from the opposing of one of the first mark and the second mark at the opposing position to the opposing of the other mark at the opposing position.

Still another object of the present invention is to provide an image forming apparatus including: a moving endless belt; a first mark arranged on the belt; a second mark arranged on the belt at a distance shorter than a half of a circumferential length of the belt from the first mark in a moving direction of the belt; a sensor provided at an opposing position to recognize that the first mark and the second mark oppose the opposing position; and a detecting portion detecting the circumferential length of the belt based on a time from the opposing of one of the first mark and the second mark at the opposing position to the opposing of the other mark at the opposing position.

Further objects of the present invention will become apparent from the following description of exemplary embodiments with reference to the attached drawings.

DESCRIPTION OF THE EMBODIMENTS

Hereinafter, exemplary embodiments of the present invention are described in detail by way of example. However, the sizes, materials, shapes and relative positions of components described in the following embodiments should be appropriately changed depending on a configuration of an apparatus to which the present invention is applied and various conditions. Therefore, the scope of the present invention is not intended to be limited thereto unless otherwise noted.

Hereinafter, an image forming apparatus according to the present invention is described further in detail referring to the accompanying drawings.

First Embodiment

[Overall Configuration of the Image Forming Apparatus]

Figure 1:
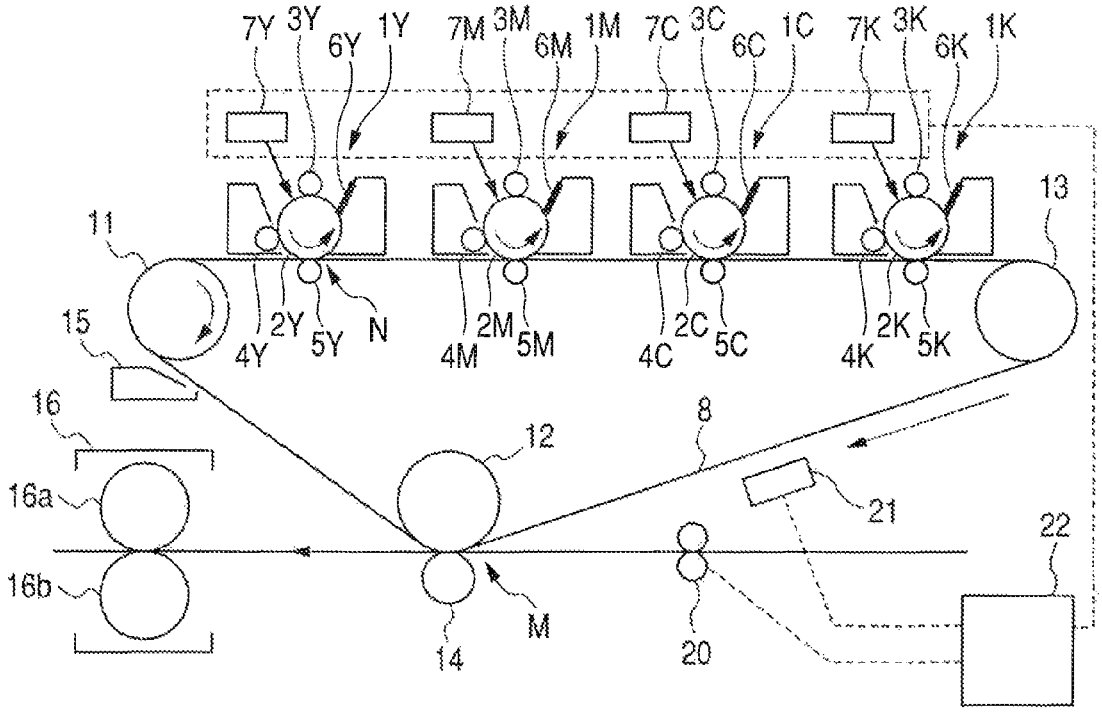
FIG. 1 illustrates a schematic configuration diagram of an image forming apparatus according to a first embodiment.
Figure 9:
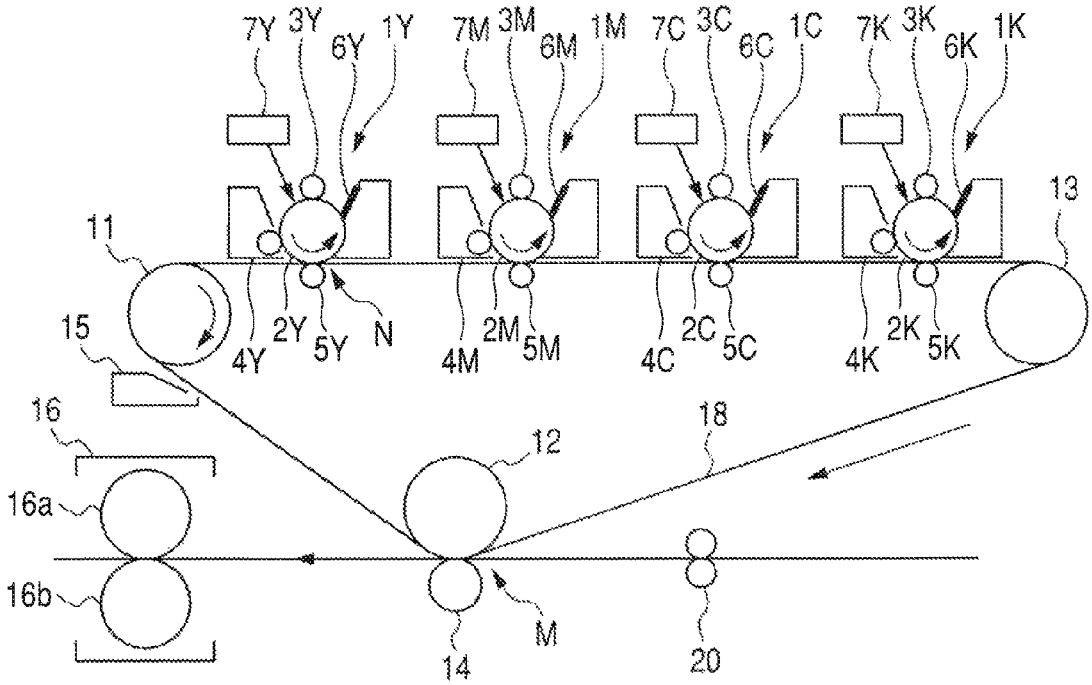
FIG. 9 BACKGROUND ART
FIG. 9 illustrates a schematic configuration diagram for illustrating the background art.

FIG. 1 illustrates a schematic configuration of an image forming apparatus according to a first embodiment. The description is given while denoting the parts having the same configurations as those of the image forming apparatus illustrated in FIG. 9 by the same reference symbols.

The image forming apparatus according to this first embodiment is a tandem image forming apparatus including a plurality of photosensitive drums arranged in a row, which respectively correspond to toner colors, to sequentially superimpose toner images on an intermediate transfer belt serving as an image bearing belt to obtain a desired image.

An image forming apparatus main body includes image forming portions (1Y, 1M, 1C and 1K) corresponding to the respective toner colors (Y: yellow, M: magenta, C: cyan, and K: black). Photosensitive drums (2Y, 2M, 2C and 2K) serving as image bearing members are respectively provided for the image forming portions 1. The photosensitive drum 2 in this first embodiment is an organic photosensitive member including a photosensitive layer (not illustrated) formed on a drum base member (not illustrated) made of aluminum or the like. The photosensitive drum 2 is rotated by a driving device (not illustrated) in a direction indicated by an arrow of FIG. 1 at a predetermined process speed.

Around the photosensitive drums 2, charging rollers (3Y, 3M, 3C, and 3K), development units (4Y, 4M, 4C and 4K), primary transfer rollers (5Y, 5M, 5C and 5K), and cleaning units (6Y, 6M, 6C and 6K) are provided in the order of a rotational direction of the photosensitive drums 2.

Above the charging rollers 3 and the development units 4, exposure units (7Y, 7M, 7C and 7K) are provided. The exposure unit 7 emits a laser beam to a surface of the photosensitive drum 2 based on image information to form an electrostatic latent image on the surface of the photosensitive drum 2.

The photosensitive drum 2 and the primary transfer roller 5 abut against each other in a primary transfer portion N through an intermediate transfer belt 8 (image bearing belt).

The intermediate transfer belt 8 is movably looped around a plurality of rollers such as a driving roller 11, a secondary transfer opposing roller 12, and a tension roller 13. In other words, a driving roller 11 and a tension roller 13 are stretching members for stretching the intermediate transfer belt 8. The intermediate transfer belt 8 is moved by the driving roller 11 in a direction indicated by an arrow of FIG. 1. The tension roller 13 is biased and supported by a spring (not illustrated) toward the right direction of FIG. 1. In this manner, a constant tension is provided for the intermediate transfer belt 8.

The intermediate transfer belt 8 can have a volume resistivity of about 1×108 to 1×1012Ω·cm. A urethane resin, a fluorine resin, a nylon resin, a polyimide resin, or an elastic material such as a silicone rubber or a hydrin rubber is used. A material obtained by dispersing carbon or a conductive powder in any of the above materials to regulate a resistance can also be used.

In this first embodiment, a black endless belt having a circumferential length of 1,000 mm and a thickness of 0.1 mm is used. The black endless belt is obtained by dispersing carbon in polyimide to regulate a volume resistivity to 1×109Ω·cm. A process speed (image forming speed) of the intermediate transfer belt 8 is set to 190 mm/s.

In this first embodiment, a plurality of marks are formed at arbitrary positions in a lateral end portion of the intermediate transfer belt 8 along a moving direction of the intermediate transfer belt 8. Distances between the marks all differ from each other. Bonding positions of the marks are described below.

An optical sensor 21 (mark detection means) for detecting the passages of the marks is provided in a downstream side of the tension roller 13. A control portion 22 for correcting conveying timing of the sheet material is also provided. The control portion 22 calculates a circumferential length variation of the intermediate transfer belt 8 from the result of detection by the optical sensor 21 to correct the conveying timing of the sheet material to synchronize the arrival timing of the toner image with the conveying timing of the sheet material. The optical sensor 21 in this first embodiment is a reflection type including a light-emitting portion and a light-receiving portion. A method of correcting the conveying timing of the sheet material is described below.

The secondary transfer opposing roller 12 is pressed against a secondary transfer roller 14 in a secondary transfer portion M through the intermediate transfer belt 8. The secondary transfer roller 14 can be brought into contact with and separated from the secondary transfer opposing roller 12.

The sheet material conveyed to the secondary transfer portion M is temporarily stopped by a registration roller pair 20 (sheet material conveying means) provided before the secondary transfer portion M. Then, in synchronous with the arrival timing of the toner image formed on the intermediate transfer belt 8 at the secondary transfer portion M, the sheet material is conveyed to the secondary transfer portion M by the registration roller pair 20.

In a downstream side of the intermediate transfer belt 8 after the secondary transfer portion M, a belt cleaning device 15 for removing and collecting the residual toner remaining on the intermediate transfer belt 8 is provided.

In a downstream side of a conveying path of the sheet material after the secondary transfer portion M, a fixing device 16 for fixing the toner image transferred onto the sheet material in the secondary transfer portion M is provided. The fixing device 16 includes a fixing roller 16*a* and a pressure roller 16*b*. The sheet material is interposed between a nip portion between the rollers 16*a* and 16*b* to permanently fix the image onto the sheet material.

[Image Forming Process]

A process of forming the image on the sheet material with the above-mentioned configuration is now described.

Upon input of an image forming operation start signal, the sheet materials are sequentially fed from a feed cassette (not illustrated) to be conveyed to the registration roller pair 20. Then, the sheet material is temporarily stopped just before the secondary transfer portion M.

On the other hand, when the image formation operation start signal is issued, the surfaces of the photosensitive drums 2Y, 2M, 2C and 2K rotating at a predetermined process speed are uniformly negatively charged by the charging rollers 3Y, 3M, 3C and 3K, respectively.

Then, based on a time-series electric digital pixel signal of image information, a modulated laser beam is emitted from each of the exposure devices 7Y, 7M, 7C and 7K to scan and expose the uniformly charged surface of each of the photosensitive drums 2Y, 2M, 2C and 2K to form an electrostatic latent image.

Thereafter, the development unit 4Y supplies the yellow toner to the electrostatic latent image formed on the photosensitive drum 2Y to visualize the electrostatic latent image as the toner image. The yellow toner image is primarily transferred from the surface of the photosensitive drum 2Y to the intermediate transfer belt 8 by a primary transfer bias applied to the primary transfer roller 5Y.

The intermediate transfer belt 8 on which the yellow toner image is transferred is moved to the image forming portion 1M. In the image forming portion 1M, the magenta toner image formed on the photosensitive drum 2M is also primarily transferred to be superimposed on the yellow toner image on the intermediate transfer belt 8 by the primary transfer roller 5M.

In a similar manner, the cyan toner image and the black toner image, which are respectively formed on the photosensitive drum 2C in the image forming portion 1C and the photosensitive drum 2K in the image forming portion 1K, are primarily transferred by the primary transfer rollers 5C and 5K to be superimposed on the yellow toner image and the magenta toner image transferred to be superimposed on the intermediate transfer belt 8. As a result, a desired full-color image is formed on the intermediate transfer belt 8.

The full-color toner image formed on the intermediate transfer belt 8 is conveyed to the secondary transfer portion M with the movement of the intermediate transfer roller 8.

The registration roller pair 20 conveys the sheet material to the secondary transfer portion M synchronous with the arrival timing of a leading edge of the full-color toner image on the intermediate transfer belt 8 at the secondary transfer portion M. The full-color toner image is secondarily transferred at a time to a predetermined position of the sheet material.

In this first embodiment, the passage of the marks formed on the intermediate transfer belt 8 is detected by the optical sensor 21. Based on the result of detection, the control portion 22 calculates a circumferential length variation of the intermediate transfer belt 8. Further, based on the calculated circumferential length variation, the control portion 22 controls the driving of the registration roller pair 20 to correct the conveying timing of the sheet material.

The sheet material, on which the full-color toner image is formed, is conveyed to the fixing device 16 to be heated and pressurized by a fixing nip between the fixing roller 16*a* and the pressure roller 16*b*. The toner image is thereby fixed onto the sheet material. The sheet material, on which the toner image is fixed, is delivered to the exterior, and a sequence of the image forming operation is terminated.

In the primary transfer, the residual toners remaining on the photosensitive drums 2Y, 2M, 2C and 2K are removed and collected by the cleaning units 6Y, 6M, 6C and 6K, respectively. The toner remaining on the intermediate transfer belt 8 after the secondary transfer is removed and collected by the belt cleaning device 15.

[Mark Bonding Position]

Figure 2:
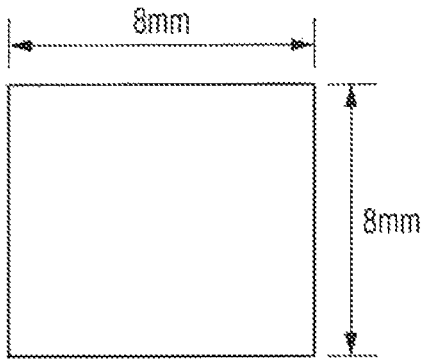
FIG. 2 illustrates dimensions of a mark in the first embodiment.
Figure 3:
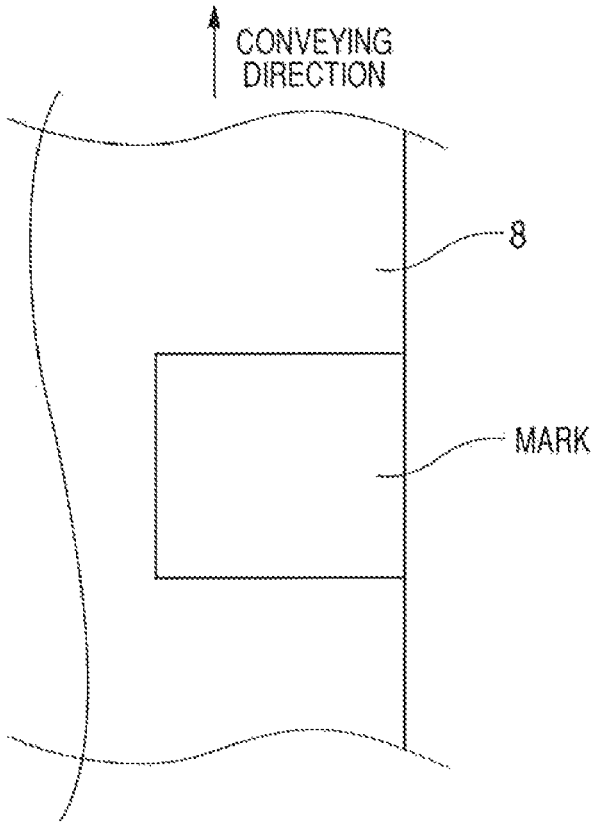
FIG. 3 illustrates a bonding position of the mark in the first embodiment.
Figure 4:
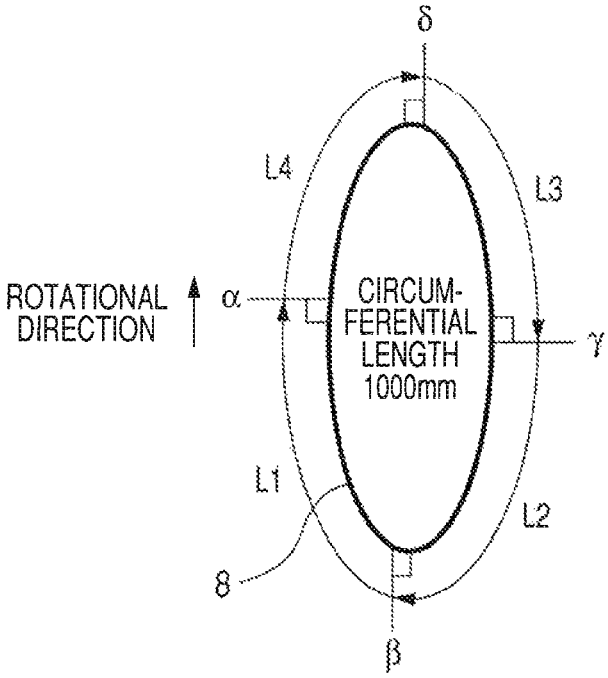
FIG. 4 illustrates the arrangement of marks in the first embodiment.

Referring to FIGS. 2 to 4, the bonding position of the mark on the intermediate transfer belt 8 in this first embodiment is described.

In this first embodiment, four marks are bonded on a lateral end portion of the intermediate transfer belt 8 along the moving direction of the intermediate transfer belt 8.

A mark for calculating the circumferential length variation can be easily distinguished from the black intermediate transfer belt 8 to allow the passage of the mark to be easily detected by the optical sensor 21. In this first embodiment, a sealing material made of white PET having the dimensions of 8 mm×8 mm is used as the mark.

In this first embodiment, four marks are arranged to set the distances between the marks to be all different from each other. Further, the marks are also arranged to make each difference between the mark distances larger at least than the double of a mark distance variation generated with the variation in circumferential length of the intermediate transfer belt 8 (Formula 1).

Assume that a difference between the mark distances is S. A condition satisfied by the difference S between the mark distances is expressed by the following Formula 1.

$$S>2\times L\times a\times T/n \quad \text{Formula 1}$$

where L is the circumferential length of the intermediate transfer belt before the occurrence of variation in circumferential length, a is a coefficient of linear expansion of the intermediate transfer belt, T is a temperature variation of the intermediate transfer belt, and n is the number of marks formed on the intermediate transfer belt.

In this first embodiment, the passage of at least two marks is detected, and a mark distance is obtained from a passage interval between the passages of the marks (ms) and a traveling rate of the intermediate transfer belt 8. The obtained mark distance and a mark distance stored in a memory R are compared with each other to obtain the circumferential length variation. For the comparison with the stored mark distance, it is necessary to identify the mark distance on the intermediate transfer belt 8, to which the mark distance obtained by detecting the passage of the corresponding mark.

In this first embodiment, four mark distances between the marks formed on the intermediate transfer belt 8 are made to be all different from each other. In this manner, the mark distance on the intermediate transfer belt 8 corresponding to the mark distance obtained by the detection of the passage of the marks can be identified.

Only with the mark distances being all different from each other, however, it is also considered that the identification of the mark distance is still difficult in some cases. Such a case is described below with an example.

For example, it is supposed that the marks are formed on the intermediate transfer belt to provide a mark distance L1: 10 mm and a mark distance L2: 11 mm. The mark distances are the mark distances in a state where no variation is generated in the circumferential length of the intermediate transfer belt. Therefore, it is supposed that the mark distance L1: 10 mm and the mark distance L2: 11 mm are stored in the memory R provided in the image forming apparatus.

It is also supposed that the circumferential length of the intermediate transfer belt is thereafter varied to extend the mark distances L1 and L2 respectively by 2 mm to provide L1' and L2'. Specifically, it is supposed that the mark distance L1': 12 mm and the mark distance L2': 13 mm are provided as a result of a variation in circumferential length of the intermediate transfer belt.

In this case, the mark distance L1': 12 mm after the occurrence of variation in circumferential length is closer to the mark distance L2: 11 mm than the mark distance L1: 10 mm before the occurrence of variation in circumferential length (L1'−L2 is smaller than L1'−L1). The mark distance is identified as the mark distance closest to the mark distance after the occurrence of variation in circumferential length among the mark distances stored in the memory R. Therefore, it is considered that the mark distance L1' after the occurrence of variation in circumferential length may be erroneously identified as the mark distance corresponding to the mark distance L2 before the occurrence of variation in circumferential length.

In order to avoid such a problem, the mark distances are made all different from each other in this first embodiment. In addition, the marks are arranged to make a difference between the mark distances larger at least than the double of a mark distance variation generated with the occurrence of variation in circumferential length of the intermediate transfer belt 8. According to this arrangement method represented by Formula 1 above, the mark distance can be identified with good accuracy. The reason is described below.

In order to identify the mark distance L1' after the occurrence of variation in circumferential length of the intermediate transfer belt as corresponding to the mark distance L1 before the occurrence of variation in circumferential length, L1' is at least required to be closer to L1 than L2 according to the method of identifying the mark distance in this first embodiment. Specifically, the following Formula 2 is required to be satisfied.

$$|L1'-L1|<|L1'-L2| \quad \text{Formula 2}$$

By Formula 2 above, the following Formula 3 is obtained.

$$2L1'<L1+L2 \quad \text{Formula 3}$$

A variation in each of the mark distances with the occurrence of variation in circumferential length of the intermediate transfer belt is obtained by dividing the circumferential length variation of the intermediate transfer belt by the number of mark distances (=the number of marks). The following formula (Formula 4) is established under the condition that the mark distances do not excessively differ from each other.

Mark distance variation ≈L×a×T/n . . . Formula 4 where L is the circumferential length of the intermediate transfer belt before the occurrence of variation in circumferential length, a is the coefficient of linear expansion of the intermediate transfer belt, T is the temperature variation of the intermediate transfer belt, and n is the number of marks formed on the intermediate transfer belt.

Since L1' is obtained by adding the mark distance variation (Formula 4) to L1, the following Formula 5 is obtained by Formulae 3 and 4 above.

$$L2-L1>2\times L\times a\times T/n \quad \text{Formula 5}$$

From Formula 5 above, by setting a difference between the mark distances (L2−L1) to a value larger than the double of the mark distance variation (L×a×T/n), L1' is closer to L1 than L2. As a result, it is possible to identify L1' as corresponding to L1 with good accuracy.

In the case of the above-mentioned example, a difference between the mark distances L1 and L2 (L2−L1) is set larger than the double of the variation (2 mm) of each of the mark distances. Specifically, the marks are arranged to make L2−L1 larger than 4 mm.

For example, it is supposed that the mark distance L1: 10 mm and the mark distance L2: 20 mm are provided. Since the difference between the mark distances (L2−L1) is 10 mm, the difference is larger than the double of the mark distance variation (4 mm). After the circumferential length is varied to provide L1': 12 mm and L2': 22 mm, the mark distance L1': 12 mm is closer to the mark distance L1: 10 mm than the mark distance L2: 20 mm before the occurrence of variation in circumferential length. Therefore, it is possible to identify the mark distance L1' after the occurrence of variation in circumferential length as corresponding to the mark distance L1.

In this first embodiment, in order to identify the mark distance with good accuracy, the four mark distances are set to be all different from each other. Moreover, the marks are arranged to set the difference between the mark distances to be larger than the double of the mark distance variation generated with the occurrence of variation in circumferential length of the intermediate transfer belt 8.

Specifically, as illustrated in FIG. 4, the four marks are arranged at circumferential positions α, β, γ and δ on the intermediate transfer belt. The marks are arranged to set mark distances as L1: 308 mm, L2: 275 mm, L3: 231 mm, and L4: 186 mm to satisfy the relation: L1>L2>L3>L4.

The coefficient of linear expansion of the intermediate transfer belt 8 used in this first embodiment is 3×10−5(/° C.). The maximum temperature variation supposed under the environment of use of the image forming apparatus is 60° C.

The maximum circumferential variation of the intermediate transfer belt, which is caused by the temperature variation, is 1.8 mm in this case. When four marks are arranged, a variation of 0.45 mm (=1.8÷4 mm) is supposed for each mark distance. Therefore, when the marks are arranged to set the difference between the mark distances to be larger than the double (=0.9 mm) of the mark distance variation of 0.45 mm, the mark distance can be identified without fail.

In this embodiment, |L1−L2|=33 mm, |L2−L3|=44 mm, |L3−L4|=45 mm, and |L4−L1|=122 mm, and a sufficient margin with respect to the double (0.9 mm) of the mark distance variation is ensured. Accordingly, the mark distance can be identified without fail.

[Method of Correcting Conveying Timing of the Sheet Material]

In this embodiment, based on the results of detection by the optical sensor 21 provided as the detection means of the marks on the intermediate transfer belt 8, a detecting portion 224 calculates the circumferential length variation of the intermediate transfer belt 8 to correct the conveying timing of the sheet material to the secondary transfer portion M.

Figure 5:
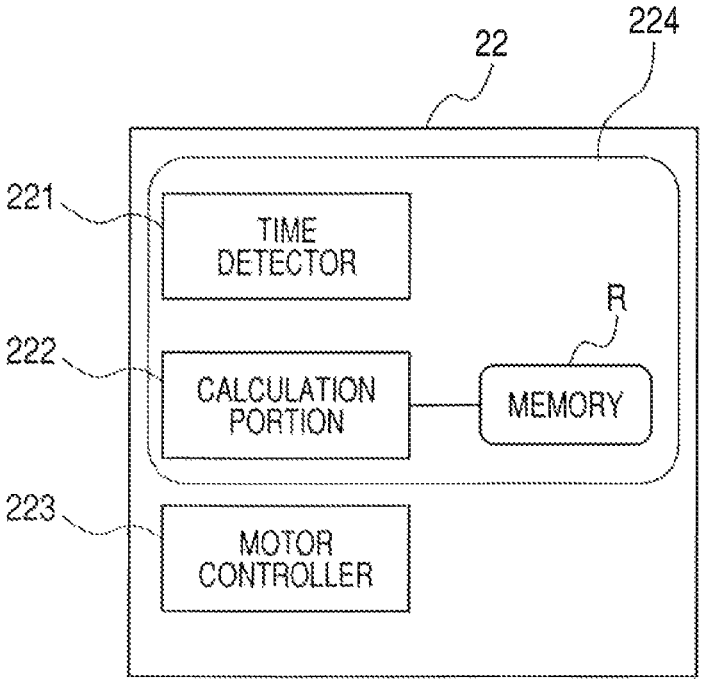
FIG. 5 illustrates a configuration of a control section in the first embodiment.

As illustrated in FIG. 5, the control portion 22 includes a time detector 221 realized by a CPU or the like, a calculation portion 222, a motor controller 223, and the memory R.

By detecting the passage of the mark with the optical sensor 21, the time detector 221 detects the passage interval between the passages of the marks.

The calculation portion 222 includes the memory R such as an EEPROM for storing each preset distance between the marks to compare the result of detection by the optical sensor 21 and information of the mark distance stored in the memory R with each other. The memory R stores each of the mark distances measured under a predetermined condition during manufacture (during calibration for a delivery inspection or the like).

The optical sensor 21 detects the passage of the mark to identify the mark distance obtained by the detection as any of the mark distances on the intermediate transfer belt 8 and to calculate the circumferential length variation of the intermediate transfer belt 8.

From the calculated circumferential length variation of the belt, a deviation amount between the arrival timing of the toner image (arrival timing at the secondary transfer portion M from the image forming portion) and the conveying timing of the sheet material (conveying timing from the registration roller pair 20 to the secondary transfer portion M) is calculated.

Based on the deviation amount obtained by the calculation, the conveying timing of the sheet material is corrected. Specifically, the motor controller 223 controls the driving of the registration roller pair 20 based on the result of calculation by the calculation portion 222.

Figure 6:
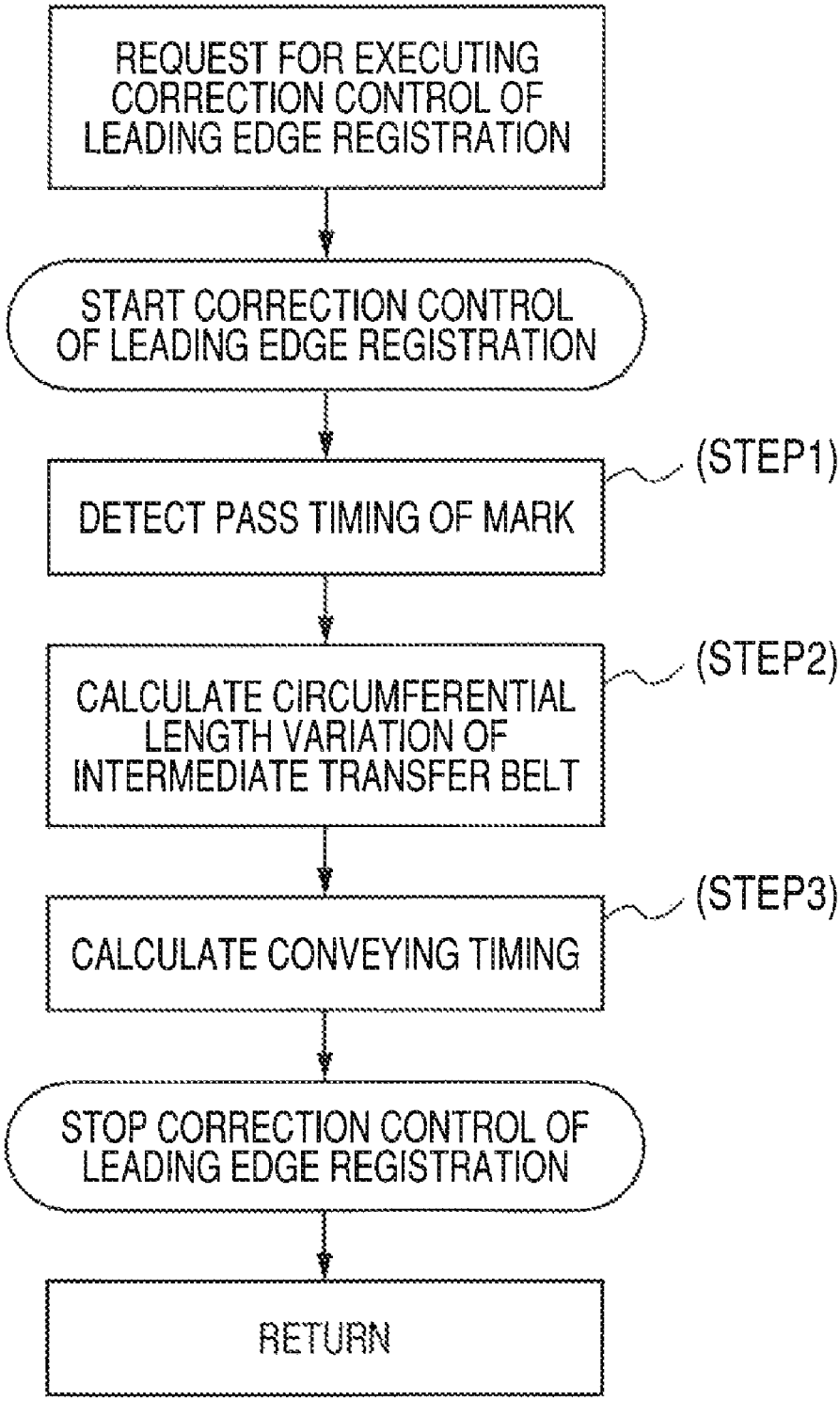
FIG. 6 illustrates a flowchart of correction control of leading edge registration in the first embodiment.

FIG. 6 illustrates a flowchart of the correction of the conveying timing of the sheet material. Hereinafter, a procedure of correction control of leading edge registration for correcting the conveying timing of the sheet material is described referring to FIG. 6.

(Start)

In response to a "request for executing correction control of leading edge registration", the correction control for leading edge registration is started. As timing of execution of the correction control, for example, arbitrary timing such as a start-up time by power-ON, during pre-rotation for image formation upon a print start signal, during continuous printing, or for execution of density correction control can be given.

(Step 1)

The pass timing of the mark is measured. When the plurality of marks passes the position opposing the optical sensor 21 serving as the detection means during the steady rotations of the intermediate transfer belt 8, a passage interval between the passages of the marks when the marks oppose the optical sensor 21 is measured.

Figures 7, 8:
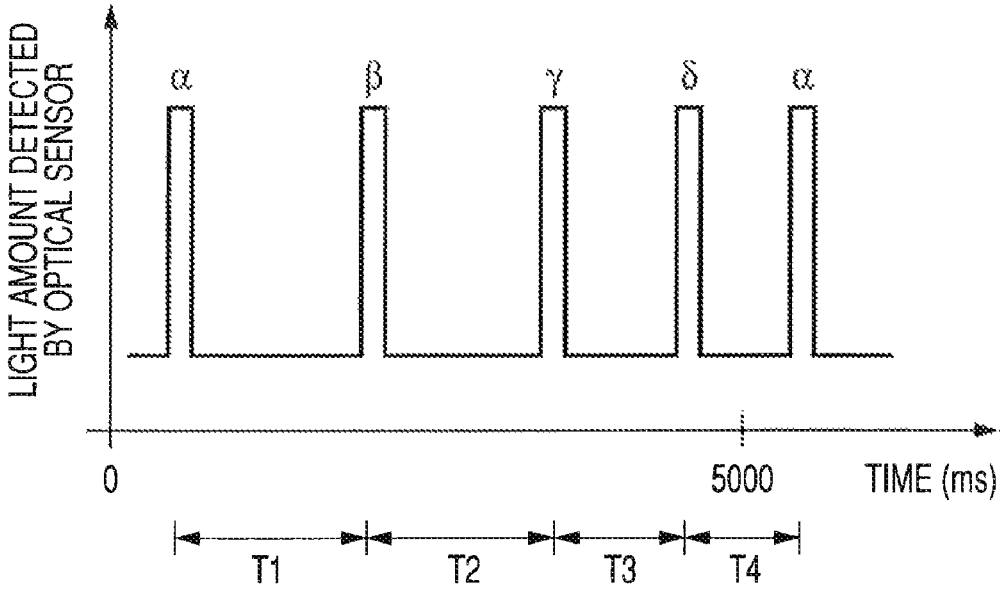
FIG. 7 illustrates a detected light amount when the passage of the mark is detected by an optical sensor in the first embodiment.
FIG. 8 illustrates results of comparison between the first embodiment and comparison examples.

FIG. 7 illustrates the results of detection when the four marks (α, β, γ and δ) are detected five times in total. As can be seen from FIG. 7, a light amount received by the optical sensor 21 is increased when each of the marks passes through the position opposing the optical sensor 21. By this increase, the passage of the mark can be confirmed. Then, a time length (T1, T2, T3 and T4) from the passage of the mark through the position opposing the optical sensor 21 to the passage of the next mark through the opposing position is measured.

(Step 2)

The mark distance is obtained from the time required for the passage of the mark. Then, the obtained mark distance and the mark distance stored in the memory R are compared with each other. From a difference between the mark distances, the circumferential length variation of the intermediate transfer belt 8 is calculated.

Specifically, each of the mark distances (a distance between the mark α and the mark β: Tαβ, a distance between the mark β and the mark γ: Tβγ, a distance between the mark γ and the mark δ: Tγδ, and a distance between the mark δ and the mark α: Tδα) stored in the memory R is to be compared. Of the mark distances stored in the memory R, the mark distance (Tx) closest to the mark distance (denoted by T12) after the occurrence of variation in circumferential length is identified. Specifically, it is possible to detect which of the marks has opposed the optical sensor 21. Thereafter, by the following Formula 6, the circumferential length variation Tdif of the belt is calculated.

$$Tdif=(T12-Tx)\times(T\alpha\beta+T\beta\gamma+T\gamma\delta+T\delta\alpha)/Tx \quad \text{Formula 6}$$

(Step 3)

From the results, the deviation amount between the arrival timing of the toner image and the arrival timing of the sheet material at the secondary transfer portion M is calculated to change the rotation start timing of the registration roller pair 20 to correct the conveying timing of the sheet material.

Since the tension roller 13 is movably biased and supported to provide a constant tension for the intermediate transfer belt 8 in this embodiment, the circumferential length variation Tdif of the belt directly corresponds to the deviation amount of the arrival timing of the toner image. Therefore, by taking Tdif into consideration as the rotation start timing of the registration roller pair 20, the conveying timing of the sheet material can be corrected.

[Results of Comparison With Comparison Examples]

In order to confirm the effects of the correction control of leading edge registration in this embodiment, comparison examples 1 and 2 are provided. The results of comparison between the embodiment and the comparison examples 1 and 2 are illustrated in FIG. 8. For each of the embodiment and the comparison examples 1 and 2, two points, that is, a period of time required to calculate the circumferential length variation of the intermediate transfer belt and the occurrence of image defect, were confirmed.

In the comparison example 1, a plurality of marks are provided on the intermediate transfer belt. The intermediate transfer belt is rotated one revolution to detect the same mark twice to calculate the circumferential length variation of the intermediate transfer belt.

In the comparison example 2, a plurality of marks are provided at equal intervals on the intermediate transfer belt. By detecting two of the plurality of marks, the circumferential length variation of the intermediate transfer belt is calculated. As described above in the background art, a manufacturing error is contained in the mark distance. Therefore, in order to further clarify the differences with this embodiment, the intermediate transfer belt having the maximum mark distance error was used.

In all of the embodiment and the comparison examples 1 and 2, the image formation was performed while the intermediate transfer belt was moved at 190 mm/s (Ref. speed).

As illustrated in FIG. 8, the image obtained in the comparison example 1 has no problem in quality, but the calculation of the circumferential length variation of the intermediate transfer belt takes a long time. The calculation time for the circumferential length variation of the intermediate transfer belt was successfully reduced in the comparison example 2, but image defect such as a color drift occurred. In the embodiment, the calculation time for the circumferential length variation of the intermediate transfer belt was reduced, while an image having good quality was successfully obtained.

According to the configuration of the comparison example 1, the intermediate transfer belt is required to rotate one revolution in order to detect the passage of the mark. Therefore, in order to detect the circumferential length variation of the intermediate transfer belt, a period of time at least long enough to rotate the intermediate transfer belt one revolution is required. Therefore, in comparison with the case where the detection of at least two of the plurality of marks is sufficient as in the embodiment, a period of time required to calculate the circumferential length variation of the intermediate transfer belt becomes longer.

According to the configuration of the comparison example 2, the passage of two of the plurality of marks is detected as in the embodiment. Therefore, it is possible to reduce the calculation time for the circumferential length variation of the intermediate transfer belt. However, the mark distance to be detected contains the manufacturing error. Thus, there is a possibility that the control portion erroneously performs the correction control of leading edge registration. Accordingly, in comparison with the embodiment, the circumferential length variation of the intermediate transfer belt cannot be calculated with good accuracy.

In the embodiment, the marks are arranged to set the mark distances on the intermediate transfer belt to be all different from each other and to make a difference between the mark distances larger at least than the double of the mark distance variation generated with the occurrence of variation in circumferential length of the intermediate transfer belt.

As a result, the image forming apparatus, which calculates the circumferential length variation of the intermediate transfer belt with good accuracy within a short period of time without rotating the intermediate transfer belt one revolution to form a good image without image defect, can be provided.

For the difference between the mark distances, a larger margin (in this embodiment, 20 mm or longer) can be provided in consideration of the manufacturing errors such as a variation in circumferential length of the intermediate transfer belt and a variation in the mark bonding position although depending on the specifications such as the speed of apparatus.

With the configuration, the manufacturing error can be absorbed and removed to allow the detected mark distance to be more surely identified on the intermediate transfer belt. As a result, more stable performance (detection accuracy) can be ensured to provide stable image quality with more reliable correction control for leading edge registration. Moreover, since lower dimensional accuracy of the component is acceptable, the cost for the members can be lowered.

Second Embodiment

The image forming apparatus according to a second embodiment of the present invention is described. Since [Overall configuration of the image forming apparatus], [Image forming process] and [Method of correcting conveying timing of the sheet material] are not different from those in the first embodiment, the description thereof is herein omitted. In this second embodiment, [Mark bonding position] which is a characteristic of the second embodiment is described.

In the first embodiment, four marks are provided at the positions $\alpha$, $\beta$, $\gamma$ and $\delta$. Moreover, the marks are arranged to set the mark distances as L1: 308 mm, L2: 275 mm, L3: 231 mm, and L4: 186 mm to satisfy the relation: L1>L2>L3>L4.

In this second embodiment, the marks are arranged to set mark distances as L1: 308 mm, L2: 186 mm, L3: 275 mm, and L4: 231 mm to satisfy the relation: L1>L3>L4>L2.

In this second embodiment, the marks are arranged in order of: a larger mark distance, a smaller mark distance, a larger mark distance, and a smaller mark distance in the rotational direction of the intermediate transfer belt. Specifically, the marks are arranged to alternate the small distance and the large distance between the adjacent marks. According to this configuration, the circumferential length variation of the intermediate transfer belt can be calculated within a shorter period of time.

For example, when the mark distances are arranged in order of larger mark distances (or smaller mark distances), the large mark distances are successive. Therefore, depending on the stop position (detection start time) of the intermediate transfer belt, the marks with the large mark distances are successively detected in some cases when two marks are detected. As a result, the detection time becomes longer than the other combinations.

In this second embodiment, the mark distances are arranged in a well-balanced manner in the order of: the larger distance, the smaller distance, the larger distance, and the smaller distance, to prevent the large mark distances from being successive. Therefore, for detection of two marks, the combination is inevitably composed of the large distance and the small distance. Therefore, as compared with the case where the marks at the large distances are successively detected, the detection time can be further reduced.

The effects of this second embodiment are also confirmed by actually performing the correction control of leading edge registration in this second embodiment. As a result, the circumferential length variation of the belt can be calculated within a short period of time with good accuracy to obtain a good image without image defect.

Other Embodiments

In the first and second embodiments, polyimide (PI) having a small coefficient of linear expansion, which is therefore relatively unlikely to be expanded, is used as the material of the intermediate transfer belt. However, the material of the intermediate transfer belt is not limited thereto, and polyvinylidene fluoride (PVDF) may also be used. As compared with PI, PVDF has a larger coefficient of linear expansion.

A case where an endless PVDF belt whose volume resistivity is regulated to 1×108 to 1×1011Ω·cm by the mixture of a conductive agent is used as the intermediate transfer belt is described. By applying 20N on each side, therefore, 40N in total, to biasing means (not illustrated) provided on both ends of the tension roller 13, a predetermined tension is applied. A modulus of elongation of the intermediate transfer belt in this embodiment is 700 MPa.

In this embodiment, four marks are provided at the positions α, β, γ and δ to set the mark distances as L1: 308 mm, L2: 275 mm, L3: 231 mm, and L4: 186 mm to satisfy the relation: L1>L2>L3>L4 as in the first embodiment. As in the second embodiment, the marks may be arranged to alternate the small distance and the large distance between the adjacent marks.

As in the first and second embodiments, two marks are detected to calculate the circumferential length variation of the intermediate transfer belt within a short period of time with good accuracy to perform the correction control of leading edge registration.

The coefficient of linear expansion of PVDF used in this embodiment is 10×10−5(/° C.). The maximum temperature variation supposed under the environment of use of the image forming apparatus is 60° C. The maximum circumferential length variation of the intermediate transfer belt, which is caused by the temperature variation, is 6 mm.

Specifically, it is sufficient to arrange the marks to set the each difference between the mark distances to be larger than the double of 1.5 mm (6 mm÷4). In this embodiment, |L1−L2|=33 mm, |L2−L3|=44 mm, |L3−L4|=45 mm, and |L4−L1|=122 mm, and therefore, a sufficient margin is ensured for the required difference.

The circumferential length variation of the intermediate transfer belt is actually calculated in this configuration to perform the correction control for leading edge registration. As a result, a good image without image defect is obtained.

Even when the material having a large coefficient of linear expansion is used, the mark distance can be identified within a short period of time with good accuracy by arranging the marks to set the mark distances to be all different from each other and to make the difference between the mark distances larger than the double of the mark distance variation generated with the occurrence of variation in circumferential length of the intermediate transfer belt.

Thus, since the intermediate transfer belt can be configured regardless of a small or large coefficient of linear expansion, the range of choices in selection of the material is expanded to achieve the reduction of manufacturing cost. In the embodiments, the mark distances are prestored in the memory R, but the data of each of the mark distances may be overwritten as needed according to the environment of use of the apparatus main body and a condition of use such as the number of fed sheets.

In the embodiments, the intermediate transfer belt is used, but the present invention is also applicable to an image forming apparatus which carries a recording material on a belt to transfer the toner image onto the recording material carried on the belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-225366, filed Aug. 31, 2007, which is hereby incorporated by reference herein its entirety.

What is claimed is:

1. An image forming apparatus comprising:

a moving endless belt;

a plurality of marks arranged on the belt so that mark distances between the marks differ from each other in a moving direction of the belt;

a sensor provided at an opposing position to recognize when one of the marks opposes the opposing position; and a control portion calculating the mark distances based on a time period between when one of the marks opposes the opposing position and when subsequently another one of the marks opposes the opposing position, and the control portion determining a circumferential length variation of the belt in the moving direction and identifying a position of the calculated mark distances in the moving direction by using the calculated mark distances.

2. An image forming apparatus according to claim 1, wherein the control portion includes a memory which stores preset mark distances.

3. An image forming apparatus according to claim 2, wherein the control portion compares the calculated mark distances with the stored preset mark distances stored in the memory.

4. An image forming apparatus according to claim 1, wherein a difference between a first mark distance of the mark distances and a second mark distance of the mark distances is greater than double of a maximum mark distance variation caused by linear expansion of the belt.

5. An image forming apparatus according to claim 1, wherein the marks consist of four marks, and satisfy the following requirements:

L1>L2>L3>L4 where the mark distances are respectively L1, L2, L3 and L4 in the moving direction.

6. An image forming apparatus according to claim 1, wherein the belt bears a toner image and the toner image borne on the belt is transferred onto a recording material at a transfer portion, and after determining the circumferential length variation of the belt in the moving direction and identifying the position of the calculated mark distances in the moving direction, the control portion corrects a conveyance timing of the recording material toward the transfer portion based on the circumferential length variation and the position of the calculated mark distances.

7. An image forming apparatus according to claim 1, further comprising a plurality of photosensitive drums, wherein a color toner image on the belt is transferred onto a recording material after toner images are transferred onto the belt from the photosensitive drums.

* * * * *